United States Patent [19]

Harper, Jr.

[11] 4,344,072

[45] Aug. 10, 1982

[54] WORN BRUSH INDICATOR

[76] Inventor: Harold L. Harper, Jr., 4517 Dennis Way, Las Vegas, Nev. 89121

[21] Appl. No.: 101,887

[22] Filed: Dec. 10, 1979

[51] Int. Cl.[3] ..... G08B 21/00

[52] U.S. Cl. ..... 340/648; 310/242

[58] Field of Search ..... 340/648, 685; 200/61.4, 200/61.41; 310/248, 249, 251, 242, 246

[56] References Cited

U.S. PATENT DOCUMENTS

| | | | |
|---|---|---|---|
| 2,590,796 | 3/1952 | Schaffer | 310/246 |
| 2,691,114 | 10/1954 | Lykins | 340/648 |
| 2,814,684 | 11/1957 | Pascale | 200/61.4 |
| 3,439,206 | 4/1969 | Grannells | 310/249 |
| 3,523,288 | 8/1970 | Thompson | 340/648 |
| 3,681,635 | 8/1972 | Bayer | 310/242 |
| 3,898,492 | 8/1975 | Vassos et al. | 310/242 |
| 4,024,525 | 5/1977 | Baumgartner | 340/648 |
| 4,121,207 | 10/1978 | Jones | 34/648 |
| 4,172,988 | 10/1979 | Lowther | 310/242 |

FOREIGN PATENT DOCUMENTS

| | | | |
|---|---|---|---|
| 1763744 | 12/1971 | Fed. Rep. of Germany | 310/248 |
| 1262486 | 2/1972 | United Kingdom | 340/648 |
| 1424522 | 2/1976 | United Kingdom | 310/242 |

*Primary Examiner*—Gerald L. Brigance
*Attorney, Agent, or Firm*—C. A. Phillips

[57] ABSTRACT

A worn brush indicator for machinery, e.g., a motor generator, wherein a carbon brush is in engagement with a moving contactor, e.g., a commutator or slip ring. The brush is made with an elongated cavity, and an insulated conductor is placed in the cavity. When the brush is worn to a point where the cavity is exposed and the insulating is worn away, the conductive member, having a carbon tip, engages the commutator, and an alarm circuit connected between the conductive member and the brush proper signals a worn brush condition.

2 Claims, 4 Drawing Figures

WORN BRUSH INDICATOR

TECHNICAL FIELD

This invention relates to motors and generators employing brushes, and particularly to a system for signalling when a brush is worn to a point that it needs replacement.

BACKGROUND ART

Since the first manufacture of direct current motors and generators, there has existed the problem of detection of worn brushes before they are worn to a point where they may damage a commutator or slip ring. Normally, the brushes, which are made of carbon, are not visible while in use, and their wear rates are not completely predictable. Thus, not infrequently, a brush will wear out before anticipated. When this occurs, it is possible that a metal cable connection to the brush, and which extends into the brush, will engage a commutator or slip ring (in case of A.C. device) and damage it. As an old problem, others have suggested solutions, and the patent art reveals a number of proposals. One of the latest is set forth in U.S. Pat. No. 4,024,525. As particularly illustrated in FIG. 4 of this patent, an elongated groove is cut in the brush, and a probe is positioned so that when the brush is worn to a selected point, the brush engages the probe and sets off an alarm. This requires auxiliary hardware to be included in the apparatus design, and in some instances, there is simply no room for it. In any event, it adds to the complexity and cost of the apparatus. A review of other patented indicators fails to reveal a simple but effective one.

It is the purpose and function of this invention to provide a simpler but effective worn brush indicator, being one that does not require any brackets or probes to be built into the using apparatus and one that can be operated without an auxiliary power source.

DISCLOSURE OF INVENTION

In accordance with this invention, a conventional brush is replaced by a brush which has an elongated cavity extending from the terminal end of the brush toward the face of the brush but terminating short of the face of the brush at a selected maximum wear point for the brush. An insulating sleeve is placed within this cavity, and a conductive member is placed within the insulating sleeve. The conductive member is terminated near the bottom or end of the cavity and thus proximate to the selected maximum wear point of the brush. Where terminated, the conductive member is formed of brush material, and from it a copper lead extends through the sleeve and then beyond the brush for connecting to external circuitry. The lead would typically have normal insulation around it after exiting the brush. A signalling circuit is connected between this cable and the body of the brush or commutator whereby, when the brush is worn to a point where the conductive member contacts the commutator, an alarm circuit is completed either directly through the commutator or through the commutator and the body of the brush.

DESCRIPTION OF THE PREFERRED EMBODIMENT

Figure 2:
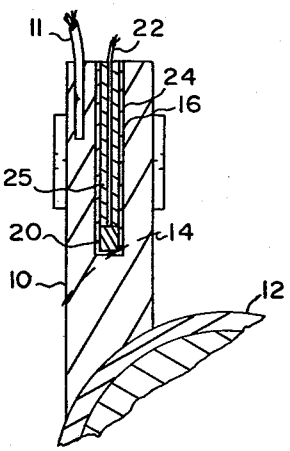
FIG. 2 is a sectional view along line 2—2 of FIG. 1 plug a portion of a commutator illustrating the usage of the invention.
Figure 1:
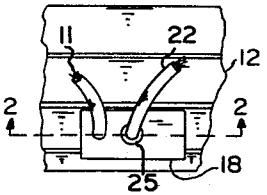
FIG. 1 is a top view of a brush as contemplated by this invention.

Referring to FIGS. 1 and 2, a brush 10 is made typically of carbon and is of the general length and configuration required for a given motor or generator. It is supplied power through conventional power lead 11. Depending upon the size and constraints provided by a brush holder to hold brush 10, brush 10 would be adapted to safely wear to some point. As shown in FIG. 2, this point is assumed to be where the brush would have worn so that it contacts commutator 12 along dashed line 14. This point is detected by the detection system of this invention which requires that brush 10 include a cavity 16 which extends from terminal end 18 of the brush to dashed line 14. A small carbon brush 20 connected to electrical lead 22 is positioned as shown in cavity 16 and insulated from brush 10 by an insulating cover 24 and insulating filler 25. Thus, brush 20 would be positioned to contact commutator 12 when brush 10 is worn to an edge corresponding to dashed line 14.

Figure 3:
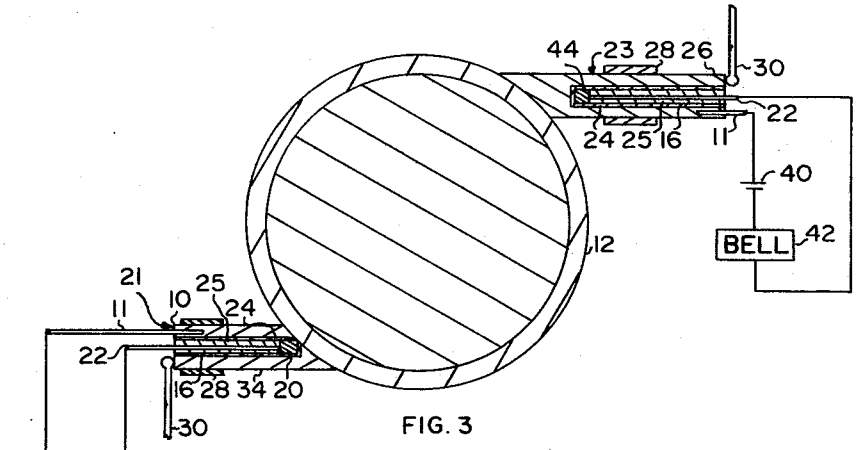
FIG. 3 is a sectional view of a portion of an electrical machine showing brushes in brush holders and illustrating different wear situations and showing circuitry for an alarm.

FIG. 3 illustrates a typical arrangement of a motor or generator having two brush assemblies 21 and 23, including brushes 10 and 26, respectively, constructed as brush 10 as shown in FIGS. 1 and 2. As shown in FIG. 3, brushes 10 and 26 are worn to different degrees. The brushes are held by conventional brush holders 28 under tension by a conventional brush bias arm 30, which effects a force on the brushes toward commutator 12 by means of a spring (not shown). In this illustration, brush 10 is worn to a point where the insulating material 24 in cavity 16 is worn away and conductive small brush 20 has commenced to engage commutator 32. Thus, small brush 20 is electrically connected via a bar of commutator 12 back to the body portion 34 of brush 20. This will complete a circuit through lead 11, power source 36, electrically operable bell 38, and lead 22 to power bell 38 and thus indicate a worn brush condition.

A similar arrangement is shown with respect to brush assembly 23, and it includes power source 40 and bell 42 connected in series between terminal 11 of brush 26 and lead 22 connected to small brush 44 within brush 26. In the case of brush 26, it will be noted that the brush is not worn to a point where small brush 44 is in contact with commutator 12, and thus it would not be in a posture to produce an alarm.

Figure 4:
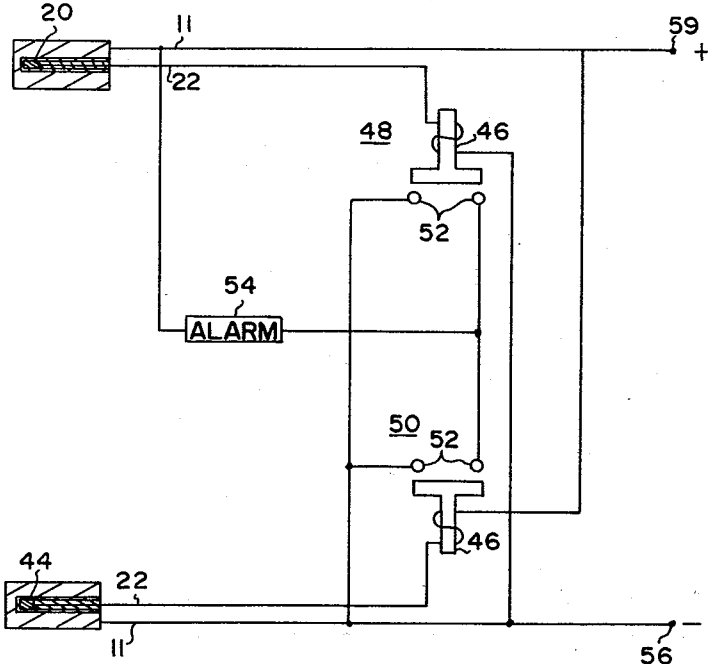
FIG. 4 is an electrical schematic diagram illustrating an alternate form of alarm circuitry.

FIG. 4 illustrates an alternate form of alarm system wherein, if either of small brushes 20 or 44 come in contact with a commutator, the body of the brush involved would be placed in circuit through the commutator with that small brush and power coil 46 of one of relays 48 and 50, which in turn would close contacts 52 of that relay to energize alarm 54 and thereby to signal a worn brush. In this illustration, both relay power and alarm power is provided by motor or generator terminals 54 and 56, which connect to brushes 20 and 26 through parallel paths provided through, and thus by the separate closing of, contacts 52 of either relay 48 or 50. The coil of relay 48 is connected between small brush terminal 22 of brush 10 and terminal 11 of brush 26, and the coil of relay 50 is connected between small brush 22 of brush 26 and terminal 11 of brush 10. Accordingly, if either of conductive members 20 or 44 engage a commutator, one of the relays will be operated to effect an alarm.

From the foregoing, it will be seen that the applicant has provided an extremely simple but effective means for the detection of a critically worn brush. It can be physically installed in place of most brushes; and as the only external addition to the brush is one additional wire, no significant increase in space requirement is involved. Alternately, the system can be powered by the power available across the brushes, or where desired, it may be independently powered as described.

I claim:

1. A worn brush indicator for an electrical machine having a rotating commutator, at least one brush holder, and a carbon brush member in said brush holder, each brush member having a conductive body and face end for effecting a sliding and conductive contact with said commutator comprising:

a cavity in said brush member extending through said brush member from an end region opposite to said face end of said brush member and toward said face end for a selected distance;

an insulating sleeve in said cavity;

a conductive member extending through said insulating sleeve to a point which is a selected distance from the face of said brush and having an essentially non-abrasive terminating surface; and signal detection means electrically connected between the body of a said brush member and a said conductive member, and including means for signalling a worn brush member when an electrical circuit is completed between a said conductive member, through said commutator, and to the body of a said brush member;

whereby, when said brush member is worn to a selected degree, said conductive member electrically engages said commutator and thereby signals a worn brush condition.

2. An indicator as set forth in claim 1 wherein said machine includes first and second said brush holders, and first and second brush members in engagement with said commutator, and said signal detection means is in circuit between the conductive member of said first brush member and the body of said second brush member and between the conductive member of said second brush member and the body of said first brush member for signalling when one of said brush members is worn by a selected amount.

* * * * *